US009803419B2

(12) United States Patent
Izod

(10) Patent No.: US 9,803,419 B2
(45) Date of Patent: Oct. 31, 2017

(54) SAFETY DEVICE AND METHOD

(71) Applicant: Safehinge Limited, Glasgow (GB)

(72) Inventor: Martin Izod, Glasgow (GB)

(73) Assignee: Safehinge Limited (GB)

( * ) Notice: Subject to any disclaimer, the term of this patent is extended or adjusted under 35 U.S.C. 154(b) by 0 days.

(21) Appl. No.: 14/408,542

(22) PCT Filed: Jun. 18, 2013

(86) PCT No.: PCT/GB2013/051578
§ 371 (c)(1),
(2) Date: Dec. 16, 2014

(87) PCT Pub. No.: WO2013/190278
PCT Pub. Date: Dec. 27, 2013

(65) Prior Publication Data

US 2015/0152680 A1 Jun. 4, 2015

(30) Foreign Application Priority Data

Jun. 19, 2012 (GB) ..... 1210841.1

(51) Int. Cl.
*E06B 7/36* (2006.01)
*E06B 3/88* (2006.01)

(52) U.S. Cl.
CPC ..... *E06B 7/36* (2013.01); *E06B 3/88* (2013.01); *E06B 7/367* (2013.01)

(58) Field of Classification Search
CPC ... E06B 7/36; E06B 3/88; E06B 7/367; E06B 2007/365
USPC ..... 49/383, 384
See application file for complete search history.

(56) References Cited

U.S. PATENT DOCUMENTS

| | | | | |
|---|---|---|---|---|
| 1,796,426 | A * | 3/1931 | Alewel | B60J 5/0495 160/100 |
| 8,499,418 | B2 * | 8/2013 | Deveze | E06B 7/362 16/250 |
| 2004/0107647 | A1 | 6/2004 | Salzman | |
| 2006/0026793 | A1 * | 2/2006 | Li | E05F 5/02 16/82 |
| 2010/0162630 | A1 * | 7/2010 | Shim | E06B 7/367 49/383 |

FOREIGN PATENT DOCUMENTS

| | | | |
|---|---|---|---|
| DE | 3626924 | A1 | 2/1988 |
| DE | 37 16 654 | A1 * | 12/1988 |
| DE | 202008016094 | U1 | 2/2009 |
| JP | H0813933 | A | 1/1996 |
| JP | 2010189879 | A | 9/2010 |
| JP | 4631958 | * | 2/2011 |
| WO | WO 2012/113139 | * | 8/2012 |
| WO | WO 2012/113139 | A1 * | 8/2012 |

* cited by examiner

*Primary Examiner* — Gregory Strimbu
(74) *Attorney, Agent, or Firm* — Dickinson Wright PLLC

(57) ABSTRACT

A safety device suitable for use with hinged doors or windows, as well as methods of installing such a device. The device comprises an elongate exclusion member that is adapted to fit within the hinge gap in an open door and acts to prevent or significantly reduce the risk of injury to a subject through entrapment of fingers of other appendages in the hinge gap present in many door and window systems. The device of the present invention is particularly suitable for retrofitting to existing door and window systems.

19 Claims, 6 Drawing Sheets

SAFETY DEVICE AND METHOD

CROSS-REFERENCE TO RELATED APPLICATIONS

The present application is a 35 U.S.C. Section 371 national stage filing of International Patent Application No. PCT/GB2013/051578, filed 18 Jun. 2013, and through which priority is claimed to UK application GB 1210841.1, filed 19 Jun. 2012, the disclosures of which are incorporated herein by reference in their entireties.

The present invention relates to a safety device suitable for use with hinged doors or windows, and to door or window systems incorporating such a safety device. The invention also relates to methods of installing such a device.

The device prevents or significantly reduces the risk of injury to a subject through entrapment of fingers of other appendages in the hinge gap present in many door and window systems. The device of the present invention is particularly suitable for retrofitting to existing door and window systems.

BACKGROUND TO THE INVENTION

It is known to provide safety devices, commonly known as door guards, hinge guards, anti-finger trapping devices or finger guards, to prevent or inhibit finger trapping accidents in doors. An opened door defines a vertical gap between the door and the door frame to which it is hinged—this is referred to as the 'hinge gap' or 'hinge cavity'. Typically, if the door is more than halfway from a closed to a fully open position (and it can be less than this in some cases), this gap is sufficiently large for a subject (e.g. a person) to insert fingers (or other appendages) into the gap. If the door is then pivoted towards the closed position, the gap is reduced resulting in injury to the person's fingers. For this reason, the hinge gap between the hinged door and the door frame is also commonly referred to as a 'pinch point'.

Resulting injuries can be severe because the door is effectively a lever with a massive mechanical advantage at the pinch point. Thus even a relatively light door can exert a crushing force at the pinch point—complete amputations of finger tips are not uncommon. Typically, children are at the greatest risk as they are less safety conscious and have smaller fingers and their inherent curiosity and lack of awareness about potential dangers leads them to insert fingers into the hinge gap without knowledge of the risks. However, the injury could happen to anyone, especially other vulnerable groups including the elderly or persons with certain disabilities, mental illnesses or learning difficulties.

Conventional door guards typically attempt to solve this problem by covering the pinch point using a flexible material or a substantially rigid but hinged material having one end fixed to the door frame (often on a door stop within the frame) and the other end fixed to the door. In many designs the guard is able to effectively increase in length to accommodate the varying distance between the two fixed ends as the door is opened. This can be achieved using stretchable materials, rolled sheet materials, concertina materials, or the like. Other examples of prior art devices use sliding arrangements and the like. Examples of known door safety devices are shown in FIGS. 1*a* to 1*d*.

However, all prior art door safety devices have significant shortcomings, which has limited their use and effectiveness in real world situations. Accordingly the dangers associated with pinch points in the hinge gap of doors remains a significant health and safety risk.

Guards which comprise flexible materials (e.g. the roller system shown in FIG. 1*c*) provide limited safety benefits because it is relatively easy for a subject to push the material into the gap, thus negating the purpose of the device. It is not possible to remedy this deficiency by simply increasing the tension in the material because this increases difficulty in opening the door. Furthermore, because of the need to comply with, for example, the UK Equalities Act, building regulations for certain buildings stipulate maximum forces required for opening or closing a door. The device in FIG. 1*c* also projects from the door (or the frame if it were mounted in the reverse orientation) and thus restricts the effective width ('clear opening width') of the doorway and renders it vulnerable to damage through impacts. Narrowing of the doorway is a particular concern where it can restrict disabled access.

Devices made from more rigid materials, for example hinged plastic guards such as shown in FIGS. 1*a* and 1*b* can provide, at least initially, a safer guard than flexible guards, but they are prone to fatigue and are also easily damaged through impact. Furthermore, particularly when damaged or worn, the guard can be prone to inversion, i.e. where it bends or folds into the gap during closing of the door. When this happens the material can be further damaged as it is crushed between door and frame, as well as providing little or no protection against injury. Furthermore, such rigid guards often split, e.g. as the result of fatigue, and thus reveal the hinge gap.

FIG. 1*d* shows an alternative device comprising an alternative system in which a rigid plate is mounted at one edge on the door stop via an elongate hinge. The other edge of the plate is mounted slidably on rails provided on the door. This design provides a comparatively safe guard but requires careful fitment, and also does not accommodate doors which open very wide, e.g. over 120° or so.

Criteria that can be used to rate and compare door safety devices include:

- Safety
- Durability
- Ease of installation
- Cost (capital and long term)
- Aesthetics
- Opening angle
- Hygiene
- Material
- Installation (ease and flexibility)

Although the discussion above is directed primarily to doors, and this is a primary focus of the present invention, the same problem with pinch point in hinge gaps can occur in windows and other systems comprising hinged closable members mounted in or on a second member.

There remains a need for improved safety devices for preventing the entrapment and crushing of fingers and the like in hinge gaps. The present invention provides an improved safety device which obviates and/or mitigates disadvantages associated with prior art devices.

STATEMENTS OF THE INVENTION

According to a first aspect, the present invention provides a safety device for use with a closable member (e.g. door or window) hingedly mounted to a second member, the device comprising an elongate exclusion member and a biasing means, the biasing means being adapted such that in use it urges the exclusion member into a hinge gap defined by a closable member and a second member when the closable member is in an open position, the exclusion member having a conformation (i.e. shape and size) such that upon closing of the closable member the exclusion member is ejected from the hinge gap against the action of the biasing means.

It is generally preferred that the second member is a frame, e.g. a door or window frame, most preferably a door frame. However, the second member can alternatively be another closable member (e.g. door) or panel, e.g. where a door or other closable assembly comprises a plurality of hinged panels. Mention can be made of bi-fold doors or other such concertina door systems, and shutters or the like. In all of these systems and arrangements a hinge gap is formed between the closable member and the second member, whether the second member is a frame or another panel or the like.

At points in the following text the closable member may be referred to specifically as a 'door' and the second member may be referred to specifically as a 'frame'. This terminology is used primarily for brevity and clarity, but it should be noted that is intended that the relevant features, embodiments or aspects of the invention discussed in relation to 'doors' and 'frames' can be applied to other closable and second members unless the context clearly dictates otherwise.

For the avoidance of doubt, it should be noted that the term 'frame' includes a door or window frame, but it also includes the body of a cabinet or the like, where the door is mounted thereto. A conventional door frame typically comprises a pair of vertical jambs which often, but not always, comprise door stops. Typically a door is hingedly mounted relative to one of the jambs via one or more hinges, often using butt hinges in conventional domestic and many commercial doors, but other hinges such as pivot hinges are relatively common too. In some cases two doors are mounted, one on each jamb. In many embodiments of the present invention the hinge gap is formed between a door and its jamb.

It should be noted that the invention is not restricted to a particular type of hinge, but is readily applied to many hinged arrangements where a hinge gap is formed during the opening and closing of a closable member. In many situations door and the like are mounted using butt hinges, but there are many other types of hinge that can be used. There are certain special hinge arrangements where no hinge gap is formed and thus the risk of crush injury is removed, but these are relatively rare compared with more conventional hinge arrangements which carry the risk of entrapment.

The invention is envisaged to be particularly suitable for use with any generally flat, panel-like closable members such as a doors or windows. However, any other closable member which is hingedly mounted and which forms a hinge gap when opened may be suitable for use with the device of the present invention.

In a preferred embodiment the biasing means comprises a resilient means. For example suitable resilient means include and elastic material, such as an elastomer, a spring or the like. A particularly preferred biasing means comprises a roll of sheet material which extends against the action of a resilient member such as a torsion spring. However, the invention contemplates all manner of biasing means which are suitable to urge the exclusion member into the hinge gap.

The device of the present invention uses an exclusion member to prevent or restrict the insertion of fingers or the like into a hinge gap. As the closable member (e.g. door) opens and the hinge gap appears, the biasing means urges the exclusion member into the gap, thus blocking entry. As the door opens further and the gap widens, the exclusion member is drawn further into the gap thus obstructing access to the, now wider, gap. When the door is closed, the exclusion member is forced out of the hinge gap as the gap narrows. Thus the device of the present invention is able to adapt to obstruct the hinge gap and thus exclude fingers and the like as a door opens and closes.

In preferred embodiments of the present invention, the biasing means acts to urge the exclusion member into a suitable position and/or orientation for ejection from the hinge gap. For example the biasing means may be adapted to orient the exclusion member in an optimum position to promote smooth ejection of the exclusion member as the door closes.

Where a door opens to, for example, 90° to 120° from its closed position, then access to the hinge gap is typically completely or largely obstructed by the exclusion member. Where a door opens wider, then, depending on the exact conformation of the door, frame and exclusion member, it is possible that the gap may become wider than the exclusion member can fully obstruct. However, even in this situation, the device acts to prevent crushing injuries. If a finger is inserted into the gap between the exclusion member and door or frame, as the door closes the finger will be urged against the exclusion member by the door or frame. The resultant movement of the exclusion member out of the hinge gap serves to eject the finger from the gap, and thus pinch points are avoided. Furthermore, in certain preferred embodiments, which are described in more detail below, the biasing means also provides a degree of cushioning during this process and the shape of the exclusion member typical reduced pressure points, thus crushing force between the door or frame and the exclusion member is avoided. Furthermore, the tension in the biasing means in specific embodiments described below further aids ejection of the finger. Additionally or alternatively, a cushioning means or friction reducing means that is separate from the biasing means could be provided to aid ejection of a finger or the like from between the door/frame and the exclusion member, e.g. a sheet of polymeric material adapted to cover a gap which opens between the exclusion member and the door or frame.

The exclusion member comprises a closable member-contacting surface and a frame-contacting surface, the surfaces being configured to facilitate ejection of the exclusion member from the hinge gap. It will be apparent to the person skilled in the art that the exclusion member must be conformed (i.e. shaped and sized) to provide suitable surfaces to allow ejection from the hinge gap to occur. It is desirable that ejection of the exclusion member is both consistent and reliable, and that it occurs with a relatively low compressive force being exerted on the exclusion member. It is worth noting that the closable member-contacting surface and a frame-contacting surface need not be in permanent contact with the closable member and/or frame during a closing or opening operation. For example, the biasing means may actually hold the surfaces away from the closable member and/or frame at certain points as the door swings open, as can be seen in the appended drawings.

The closable member-contacting and second member-contacting surfaces can run along substantially the entire length of the exclusion member, with the profile of the exclusion member which defines the surfaces remaining substantially constant along this length.

In preferred embodiments, however, the closable member-contacting and second member-contacting surfaces do not run along the entire length and are intermittent along the length of the exclusion member. For example, a plurality of closable member-contacting and second member-contacting surfaces can be provided at least at or near each end of the exclusion member, and optionally at other points along its length. In a particularly preferred embodiment the closable member-contacting and second member-contacting surfaces are provided by projections provided at intermittent points along the length of the exclusion member. For example the projections may be provided near each end of the exclusion member, and at one, two or more intermediate points along the length of the exclusion member. Such projections may conveniently be provided by spacers, or can be integral to the main body of the exclusion member. The projections can advantageously be positioned at desired locations on the exclusion member to facilitate ejection. This can be particularly useful where a door and/or frame has regions having an irregular surface, e.g. where a hinge is mounted and screws or the like project from the surface. Such irregular regions could impede smooth operation of the device, e.g. if a screw head snags the exclusion member, and, as such, it can be useful to avoid contact at these regions.

In certain embodiments it is preferred that intervening regions of the exclusion member between such projections are configured such that they do not leave a significant gap, e.g. a finger-width gap, which could allow insertion of a finger. Thus, it is preferred that the projections do not project from the surface of the remainder of the exclusion member to such an extent as to significantly space the exclusion member from the closable member/frame in use. Suitably such projections have a similar profile to the surface of the intervening regions of the exclusion member. However, in other embodiments, there can be more significant gaps. In particular, where the device comprises means to cover over any such gaps, then there is not a need to keep the gaps so small. For example, in the specific embodiment described below the fabric sheets prevent or resist insertion of a finger even where the gaps are relatively large.

There are potentially a large number of possible conformations of the closable member-contacting and second member-contacting surfaces that would allow ejection to occur. Furthermore, some shapes and sizes may work well with certain closable members and/or frames or with certain hinge systems, but less well with others. Examples of conformations which are described below which are particularly suitable, but it should be borne in mind that shapes and sizes other than those described below may perform adequately, or indeed may be optimal in certain situations. It would be routine to test any particular exclusion member for adequate performance in terms of ejection with any combination of closable member and second member. An exclusion member that is prone to becoming entrapped in the hinge gap rather than being ejected is undesirable. When the exclusion member becomes trapped it prevents the closable member from closing and also may cause damage the safety device.

There are two principal ways in which the exclusion member could become trapped in the hinge gap. Firstly, the geometry of the closable member and the second member, e.g. a frame (possibly including a stop, e.g. a door stop), could geometrically trap the exclusion member. Secondly, frictional forces between the exclusion member and the closable member and/or second member could be larger than the force exerted upon the exclusion member, causing the assembly to bind. Both of these issues can be addressed, principally by ensuring the shape and dimensions of the exclusion member (in particular the closable member-contacting and frame-contacting surfaces) is suitable to prevent the occurrence of a geometric trap and avoids geometries which are prone to generating high levels of friction. In general it is preferred that as the hinge gap closes the angles where the exclusion member and the closable member and second member contact are such as to strongly favour ejection when the exclusion member is squeezed between the closable member and second member.

It is desirable that the device is adapted such that extraneous forces, e.g. sabotage and/or accidental forces, applied to the device cannot readily cause the exclusion member to become trapped. For example, it can be envisaged that a person may attempt to manipulate the exclusion member into a position where it would become trapped, perhaps out of mischief or merely out of curiosity. Alternatively, a force applied to the device, e.g. a person or article leaning against it, could urge the exclusion member into atypical orientations within the hinge gap. Of course, it is not possible to configure a device to resist all forms of sabotage or accidental forces, but careful configuration of the exclusion member and/or biasing means can provide a device which is highly resistant to adverse effects of such forces. The specific embodiments described below achieve this by providing an exclusion member which is shaped such that it is highly resistant becoming trapped. Furthermore the biasing means is adapted such that it constrains the orientation of the exclusion member and prevents it from being manipulated into an orientation where it can be trapped. Thus, in preferred embodiments, the exclusion member and/or biasing means are configured to prevent the device malfunctioning even when extraneous forces are applied to the device.

In a preferred embodiment the exclusion member comprises a surface having a curved profile which defines the closable member-contacting surface and the second member-contacting surface. In general it has been found that a continuous curved profile provides a highly suitable shape to provide reliable ejection of the exclusion member. For example, a suitable profile could define an arc, e.g. a circular or elliptical arc. Alternatively, the curved portion could define a parabolic shape or could be an irregular curve.

However, in alternative embodiments one other or both of the closable member-contacting surface and the second member-contacting surface could be defined by flat surfaces. Such flat surfaces could be separated by a curve or corner.

The specific dimensions of the surfaces will be dependent on the dimensions and geometry of the closable member and the second member. Where the second member is a frame the presence or absence of a door stop may have a significant effect. In general a comparatively large exclusion member will be less prone to becoming trapped than a smaller one, but there is a balance to be struck such that reliable operation is achieved but the exclusion member does not become so large as to be aesthetically problematic or cause occlusion of the opening, e.g. doorway.

In a preferred embodiment the exclusion member comprises a main body having a substantially constant cross section and projections (e.g. spacers) provided intermittently at positions along the length of the exclusion member that define a plurality of closable member-contacting and second member-contacting surfaces. In alternative embodiments, which are generally less preferred, the exclusion member has a substantially constant cross section and has a continuous closable member-contacting and second member-contacting surface along the entire length of the exclusion member.

The exclusion member suitably has the general form of a cylinder, prism or suchlike. A particularly preferred form is a semi-cylinder.

Preferably the closable member-contacting surface and a second member-contacting surface are defined by an arcuate surface of the exclusion member or spacer provided thereon. More preferably the closable-member contacting surface and second member-contacting surface are defined by an arcuate surface which has a profile substantially defining an arc of a circle or ellipse.

In a particularly preferred embodiment the elongate exclusion member comprises a substantially semi-cylindrical member. The arcuate surface of the semi cylindrical member can define the closable-member contacting surface and second member-contacting surfaces. Alternatively, and indeed preferably, the arcuate surface of the semi-cylindrical member is provided with a plurality of projections, e.g. spacers, which define a plurality of arcuate closable member-contacting and frame-contacting surfaces.

Preferably the elongate exclusion member has a length which corresponds to the length of a corresponding hinge gap. Where one is considering a door, the hinge gap will be approximately the height of the door. In certain preferred embodiments the exclusion member is slightly shorter than the hinge gap, for example to provide clearance from the floor. For example, the exclusion member may be from 10 to 50 mm shorter than the length of the hinge gap; this allows for a suitable gap at the bottom of the device to provide clearance from the floor.

Suitable biasing means can comprise any means adapted to urge the exclusion member into the hinge gap when the closable member is opened. The biasing can be achieved through use of a resilient means or it could be achieved using a natural force such as gravity of magnetism. In preferred embodiments the biasing means comprises a resilient means which urges the exclusion member into the hinge gap.

Preferably the biasing means serves to correctly orientate the exclusion member with respect to the closable member and/or second member. Furthermore, it can prevent extraneous forces from moving the exclusion member into an undesirable orientation, e.g. where it might be trapped, as discussed above.

In a preferred embodiment the safety device comprises two biasing means, the first extending between the exclusion member and the frame and the second extending between the exclusion member and the closable member.

The biasing means can suitably comprise a sheet of material. More preferably the biasing means comprises a sheet of substantially non-elastic material which is mounted to extend against the action of a resilient means and retract under the influence of the resilient means. In a preferred embodiment the biasing means comprises a roll of sheet material which is adapted to extend against the action of a resilient means. For example, the biasing means can extend against the action of a torsion spring.

In a particularly preferred embodiment the first and second biasing means each comprise a roll of sheet material which is adapted to extend against the action of a biasing means. The sheets of material extend along substantially the entire length of the exclusion member. In such embodiment of the invention the sheets of material can provide multiple benefits. Firstly, they act as biasing means to locate the exclusion member in the correct position. Secondly, they act as additional safety means because they prevent a finger or the like being inserted into a gap between the exclusion member and the closable member/second member. Thirdly, they act to facilitate the ejection of a finger or the like which is forcibly inserted into the gap; the combination of the tension in the sheet material and the comparatively low friction of the material serves to greatly facilitate ejection. Fourthly, they can act to correctly orient the exclusion member in the hinge gap, and prevent extraneous forces (e.g. sabotage) from moving the exclusion member into an orientation where it would become trapped; this is described in more detail below.

Suitably the first and/or second biasing means comprises stop means to limit extension of the biasing means. In a particularly preferred embodiment the first biasing means comprises stop means which is adapted to limit extension of the first biasing means before the second biasing means reaches its limit of extension when in use. This embodiment is particularly useful to prevent the exclusion member from migrating along the door. The amount that the first biasing means should extend will depend on the dimensions and geometry of the closable member and frame. In certain embodiments the first biasing means is adapted to stop once the exclusion member has substantially moved beyond a stop provided on the frame. Typically the first biasing means comprises a stop means which prevents extension beyond a distance of from 20 to 50 mm.

As mentioned above, in certain embodiments the exclusion member comprises a main body and at least one spacer affixed thereto. Conveniently a spacer can allow for modification of the shape or dimensions of the exclusion member. For example, one or more spacers can be fitted to the exclusion member to increase its size to allow it to be used with different door/frame combinations. The spacer is preferably adapted to provide the closable member-contacting surface and/or second member-contacting surface. As mentioned above, the spacer can be provided at various points along the length of the exclusion member, thus defining a plurality of closable member-contacting and frame-contacting surfaces spaced intermittently along the length of the exclusion member. Alternatively, a single spacer can extend along substantially the entire length of the exclusion member, but this is generally less preferred for the reasons given above.

A significant advantage of using a main body and spacer system is that it allows a standard main body to be used with different spacers for different door and other closable member assemblies. This means only one or relatively few different main bodies need to be manufactured, thus allowing for simplicity and reducing manufacturing costs. Furthermore, spacers can readily be replaced when they become worn.

In a particularly preferred embodiment the spacer has an inner profile matching the profile of the main body exclusion member, and an outer profile defining the closable member-contacting and second member-contacting surfaces. Suitably the inner and outer surfaces are generally arcuate.

Preferably the one or more spacers are adapted to releasably connect to the main body of the exclusion member. For example, a projection on a spacer can be adapted to clip into a recess on the main body, or vice versa. In a preferred embodiment the inner surface comprises of the spacer comprises a projection adapted to engage with a corresponding recess provided on the exclusion member, thereby connect the two components together. Other attachment methods may of course be used, e.g. other forms of clips, adhesives, screws, etc.

Preferably the closable member-contacting surface and/or second member-contacting surface are formed from a material having a low coefficient of friction, for example PTFE. This further assists in facilitating ejection of the exclusion member by reducing friction between the exclusion member and the closable member or frame.

In a further aspect the present invention provides a closable member assembly (e.g. a door or window assembly) comprising a safety device as set out above. The safety device is mounted so that the exclusion member is urged into the hinge gap by the biasing means when the closable member is opened.

In a further aspect the present invention provides a method of installing a safety device as described above to a door or window assembly comprising the steps of:

providing the device; and connecting the biasing means to the closable member and/or second member such that the exclusion member of the device is urged into the hinge gap when the closable member is opened.

In a further aspect the present invention provides the use of a safety device as described above to prevent or mitigate injuries caused by entrapment digits in the hinge gap of a closable member assembly.

SPECIFIC DESCRIPTION

Embodiments of the invention will now be described, with reference to the drawings in which:

FIG. 1*a* to 1*d* show prior art devices;

Figure 6:
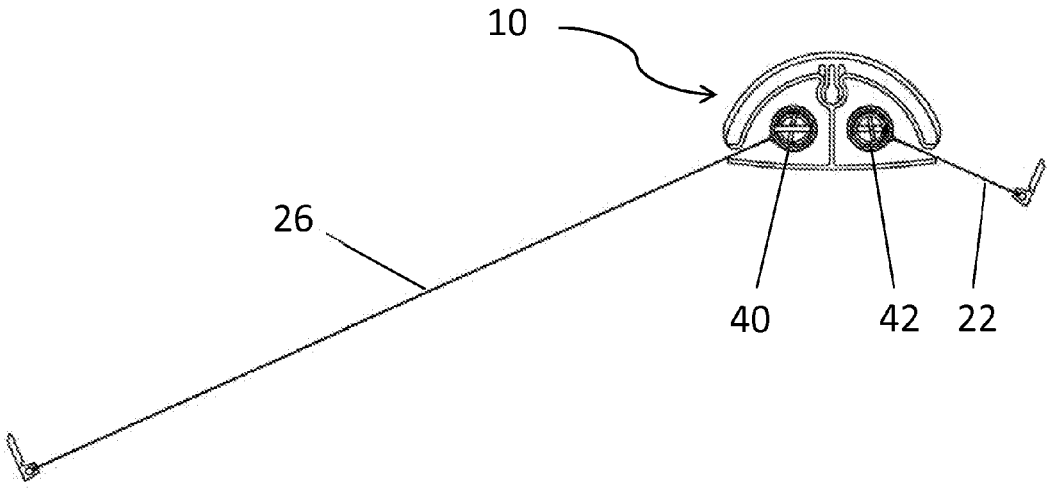
FIG. 6 shows a cross-section though the device of FIG. 4.
Figure 6A:
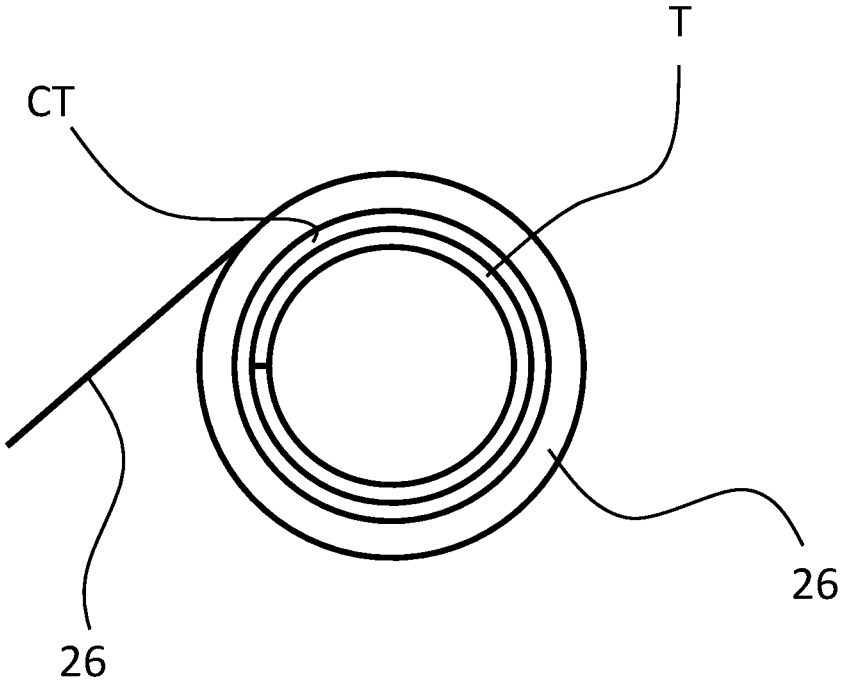
Figure 7:
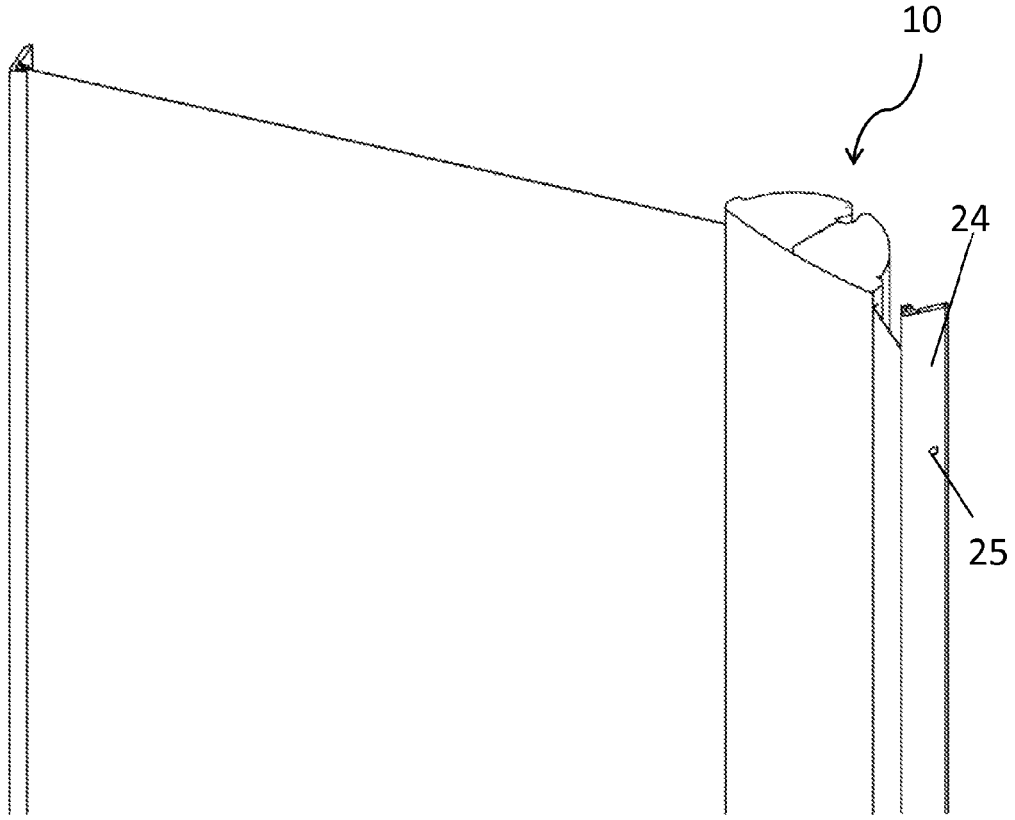

FIG. 6*a* is a simplified depiction of one of the roller assemblies of FIG. 6, illustrating the sheet material, central tube and torsion spring thereof; and FIG. 7 is an isometric view of the device.

Throughout the following description the closable member is exemplified as a door which is mounted on a second member which is a frame. Although use of the device with doors hingedly mounted on frames is envisaged as the most common utility, it should be understood that the device could be used with windows, bi-fold doors, or other such hinged arrangements where entrapment of fingers and the like is a concern.

Figure 1A:
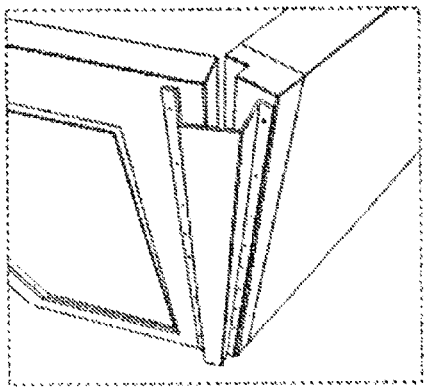
Fig. 1a PRIOR ART
Figure 1B:
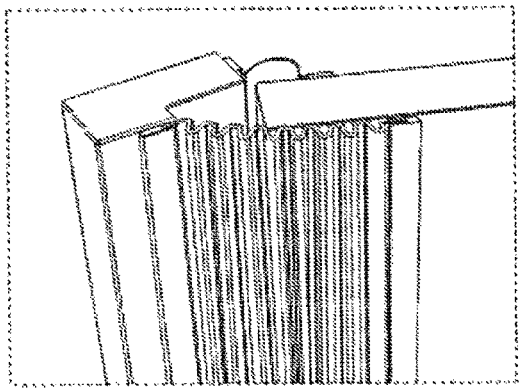
Fig. 1b PRIOR ART
Figure 1C:
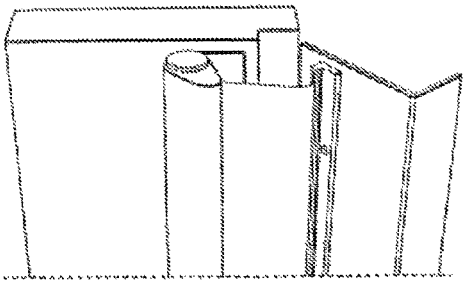
Fig. 1c PRIOR ART
Figure 1D:
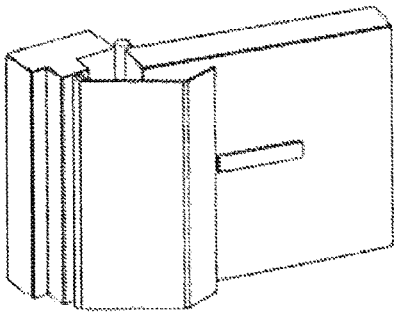
Fig. 1d PRIOR ART
Figure 2:
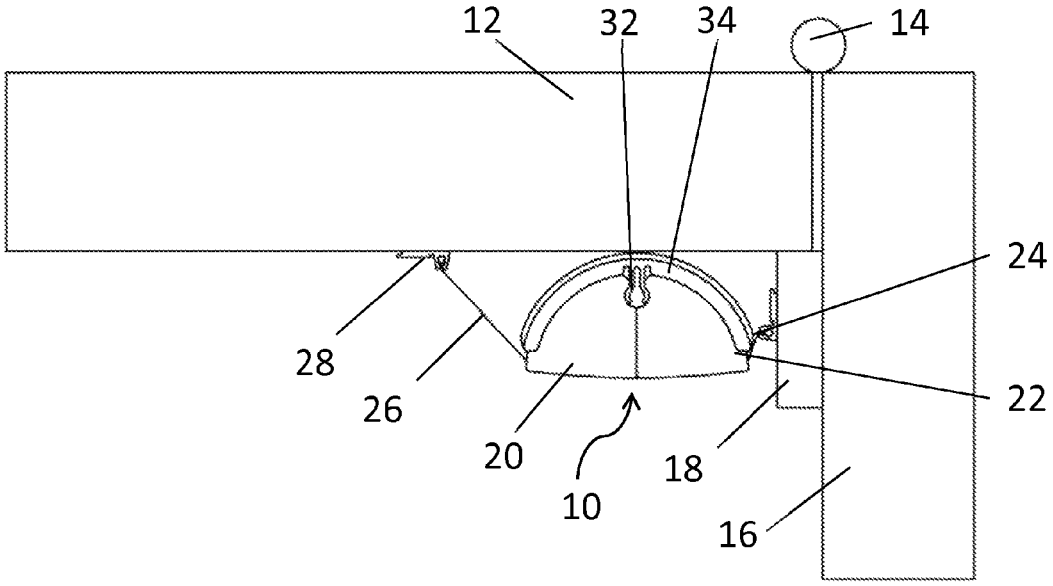
FIG. 2 shows a device according to the present invention installed on a door wherein the door is closed.
Figure 3:
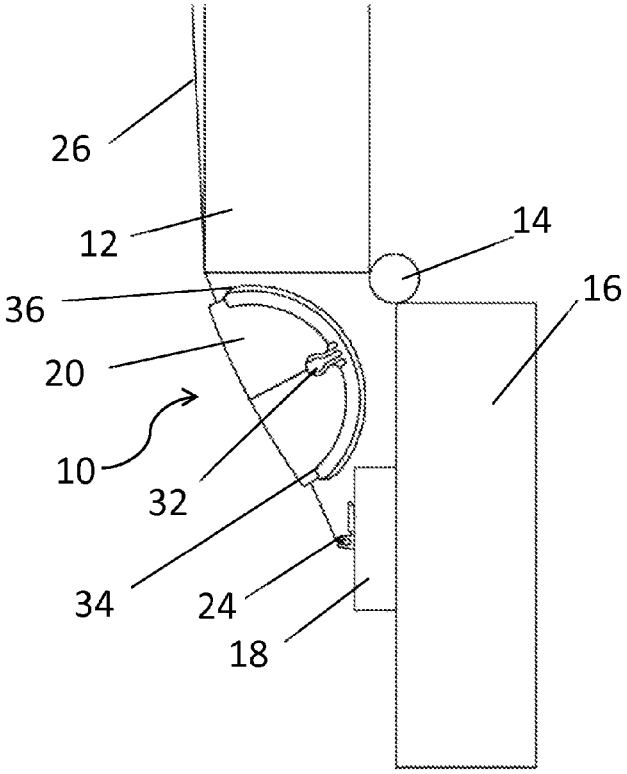
FIG. 3 shows the same device when the door is opened to approximately 90°.
Figure 4:
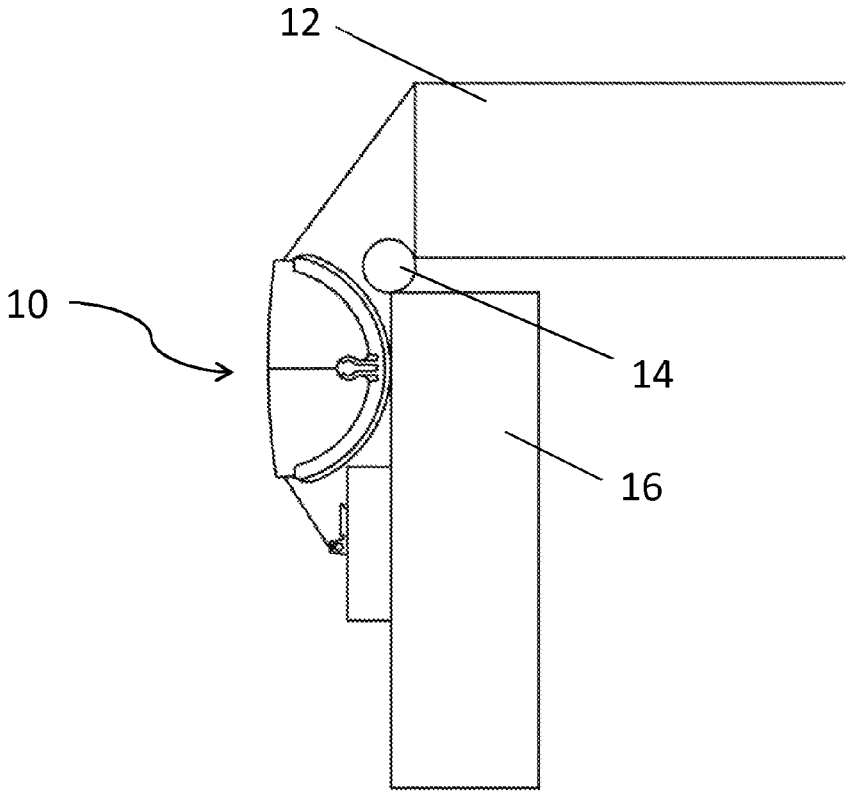
FIG. 4 shows the same device with door opened to approximately 180°.

As shown in FIG. 2 a safety device 10 is installed on a door 12 and doorstop 18 of a frame 16, which is hingedly connected to the door 12 by a hinge 14. FIG. 3 shows the same device, door and frame, but the door is opened by ~90°, thus creating a hinge gap. FIG. 4 shows the same arrangement with door opened further, to approximately 180°.

In the embodiment shown, the exclusion member 20 comprises an elongate substantially semi-cylindrical main body. The exclusion member is substantially the same length as the hinge gap on the door 12 and from to which is fitted—it may in fact be slightly shorter to permit convenient installation. In a preferred embodiment the device is a suitable length to leave a gap of approximately 30 mm between the bottom of the exclusion member and the floor.

The exclusion member 20 comprises a plurality of spacers 34. Each spacer 34 has a curved inner surface which has a profile which substantially corresponds to the curved outer surface of the main body of the exclusion member 20; in the present embodiment both surfaces are arcuate although other shapes could be envisaged.

Each spacer 34 is releasably connected to the main body of the exclusion member by a protrusion 32 located in the middle of the curved inner surface of the spacer that clips into a channel provided on the main body of the exclusion member 20 which runs down its entire length. Sliders can be positioned at any desired longitudinal position on the exclusion member, and their position can be altered if required by sliding them down the channel. The spacer 34 defines an arcuate outer surface 36, which provides a door-contacting surface and a frame-contacting surface. In the example shown in the figures, both the door-contacting surface and frame-contacting surfaces are provided by the arcuate outer surface of the spacers 34—other configurations for the door-contacting surface and a frame-contacting surface are of course possible, but the arcuate conformation has found to be particularly suitable.

Spacers 34 are attached at each end of the main body of the exclusion member 20, and also at intermediate points along its length. The positioning of the spacers 34 is selected to ensure that they are located away from regions of the door and frame where there are surface irregularities which would interfere with smooth sliding of the slider against the door or frame, e.g. hinge plates and screws or the like.

The spacers 34 can conveniently be formed from a polymer, e.g. HDPE or the like. It is generally preferable that at least the outer surface 36 of the spacers is formed from a material having a relatively low coefficient of friction, e.g. HDPE or a fluorpolymer such as PTFE.

It is, of course, not necessary that the exclusion member 20 comprises one or more spacers 34, and the door-contacting and frame-contacting surfaces can be defined by the surface of the main body. However, using one or more spacers allows for convenient replacement of the surfaces when they become worn, and also allows ready adaptation of the exclusion member 20 for different doors and frames by fitting a suitable spacer having the appropriate profile. Furthermore, as mentioned above, where a plurality of spacers are provided defining intermittent door-contacting and frame-contacting surfaces, it means that surface irregularities can be avoided—this effect could also be achieved by using a main body with projections at various points along its length which define door-contacting and frame-contacting surfaces, but this is likely to be more complex to manufacture and thus generally less desirable.

The device 10 comprises a first biasing means 22 and a second biasing means 26. The first 22 is anchored to the doorstop 18 by means of a bracket 24. As best seen in FIG. 7, the bracket 24 comprises holes 25 at points along its length for attachment via, e.g. a screw. The bracket 24 could be attached by other suitable means such as adhesive. The second biasing means 26 is attached to the door 12 via a bracket 28 in a similar way to the first.

Figure 5:
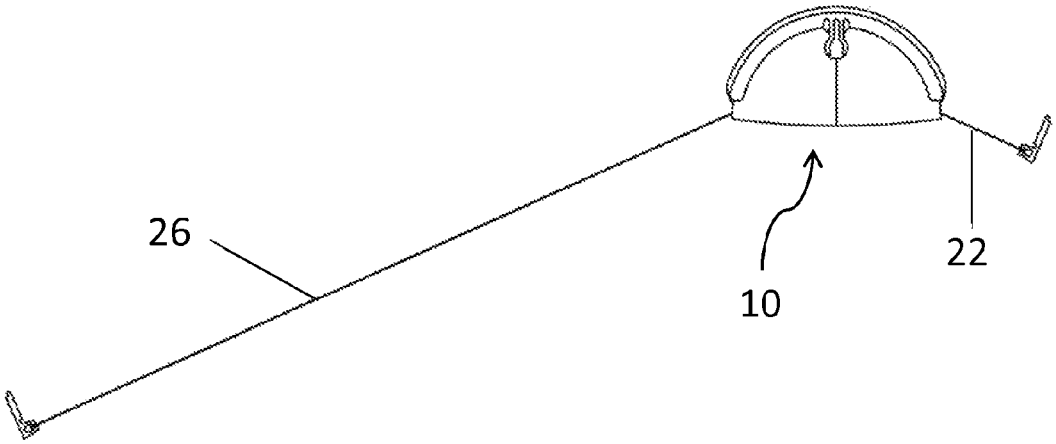
FIG. 5 shows the same device in isolation from the door, with both biasing means fully extended.

FIGS. 5, 6 and 6*a* show the device separate from the door and frame with the first and second biasing means 22 and 26 fully extended. In the example shown, the biasing means 22 and 26 comprise two roller assemblies, which dispense sheet material. The rollers 40 and 42 are shown in cross section in FIG. 6, and comprise a central tube CT about which the sheet material is rolled. Inside the tube is a torsion spring (designated T in FIG. 6*a*) which is anchored to the exclusion member 20 at one end and attached to the tube at the other. The rollers 40 and 42 are rotatably mounted within the main body of the exclusion member, each roller occupying a separate longitudinal compartment. The rollers 40 and 42 are rotatably mounted on spindles provided on end caps which are fitted into each end of the exclusion member. The material leaves the rollers 40 and 42 and exits the exclusion member 20 through longitudinal slots provided which run along opposite corners of the exclusion member.

As can be seen, when the door 12 is opened, the biasing members 22 and 26 are pulled because the distance between the brackets 24 and 28 increases. The sheet material thus extends out of the exclusion member 20 as the rollers 40 and 42 rotate against the action of the torsion spring.

The first biasing means 22 is adapted such that rotation of the roller 42 stops after a predetermined amount of material has been deployed. This distance can be adapted such that it ensures that the exclusion member 20 aligns correctly with the hinge gap. Typically the roller will stop once the corner of the exclusion member has passed the doorstop. Furthermore, this configuration prevents problems which can arise in certain situations where the exclusion member 20 can become trapped against the face of the door 12 during the opening process, which prevents correct functioning of the device—this problem cannot occur when the extension of the first biasing means 22 is limited, as discussed above. In the embodiment shown in the figures, further extension of the material is prevented because of the amount of material wrapped around the central tube; once this has been unrolled further extension is stopped. However, it is envisaged that other stop means could be used. Typically the first biasing member is permitted to extend by approximately 20 to 50 mm before further extension is stopped, but this distance may be different in various different door and hinge assemblies.

As the door 12 continues to open the biasing means 22 and 26 urge the exclusion member 20 into the hinge gap. This provides a barrier to the insertion of a finger into the hinge gap. The exclusion member 20 physically obstructs the hinge gap. Furthermore, the sheet material of the biasing means 22 and 26 further prevents insertion of a finger. If the door 12 were opened even further it can be seen that a gap would result between the exclusion member 20 and the edge of the door 12. However, such a gap would be covered by the sheet material of the biasing means 26, thus preventing insertion of a finger.

When the door 12 is closed, the hinge gap reduces in size. The exclusion member 20 (in particular the outer surface of the spacers) will abut against the door 12 and the frame 16 and will be squeezed therebetween. As a result of the force exerted on the exclusion member 20 by the door 12 and frame 16 or stop 18, it is ejected from the narrowing hinge gap against the action of the biasing means 22 and 26. The confirmation of the exclusion member 20 has been selected such that it does not become trapped in the hinge gap as it closes. In fact, tests show that the device 10 shown in FIGS. 2 to 7 operates correctly even if someone endeavours to sabotage the device by holding the exclusion member in an incorrect position. The extension limitation on the first roller is particularly useful in this regard because it prevents the exclusion member from being rotated significantly.

As discussed briefly above, even if a finger were inserted into the gap between the exclusion member 20 and the door 12 and the door were allowed to close, the finger would be ejected from the potential pinch point before damage occurs. The rolling action of the exclusion member being ejected combined with the tension on the sheet material serves to push the finger out of the gap without being subjected to a crushing force.

Installation of the device 10 according to the present invention is very straightforward. A device 10 having a suitable length for the door assembly is selected. It is envisaged that a number of different lengths of device 10 would be provided to cater for the majority of common door heights. Additionally, the device 10 could be customised by cutting the various elongate components and sheet material, analogous to the way a roller blind is cut to size. Suitable spacers 34 are attached to the exclusion member 20 to ensure suitability of the profile of the exclusion member 20 for the particular door/frame geometry. Care is taken to position the spacers to avoid interference from hinge plates, screw heads or the like. The device 10 is then placed in position against the corner defined by the door 12 and frame 16, e.g. on the door stop 18. The first bracket 24 is affixed to the frame and the second bracket 28 is affixed to the door.

In general the order in which the brackets are attached is not significant. However, in a preferred installation method the first bracket to be attached is mounted such that the screw heads are then concealed by the material. Preferably the bracket mounted to the frame is mounted first. This method if installation is primarily for aesthetic reasons, but it may also be desirable to conceal the screw heads for other reasons, e.g. to prevent things catching on them or to reduce the risk of tampering.

The two brackets 24, 28 are ideally in a substantially parallel arrangement to ensure smooth operation of the roller mechanism. The exact location for fixation of the brackets 24,28 is not particularly critical, but should be generally along the lines shown in the illustration in FIG. 2. Additionally, the bracket mounted to the frame should be positioned to ensure that the resilient means stops extending once the exclusion member has moved into the desired location, e.g. in the embodiment illustrated this is once the edge of the exclusion member has passed the stop provided on the frame.

An advantage of the device 10 of the present invention is that it is very easy to fit and is tolerant of minor misalignments in installation. The device is then ready for use.

To replace the spacers 34, e.g. if they become worn, access to the device is achieved by removing one of the brackets 25 and 28. The spacers 34 can then be unclipped and replaced with new spacers.

There are a range of conventional methods of manufacture suitable to make the various component parts of the device. In a preferred embodiment the central body of the exclusion member 20 is extruded. Extrusion is particularly suitable for forming elongate components with a constant cross section. Aluminium is a preferred material for the main body of the exclusion member 20, although various high strength plastics materials or other metals (e.g. steel) may also be suitable. Various other component parts, e.g. the spacer 34 and brackets 24 and 28, can also be manufactured by extrusion, typically in plastics for the spacer and aluminium for the brackets. Parts could also be made by injection moulding or other well-known techniques. The sheet material suitably comprises an abrasion resistant material with high tensile strength, e.g. nylon or Kevlar® fabric.

Modifications to the specific embodiments described can be made without departing from the scope and spirit of the invention. For example, other biasing means can readily be envisaged, such as replacement of the rollers with elastic materials. Alternatively, there could be a single biasing means rather than the two used in the specific example—this could be an elastic member extending from the exclusion member into the hinge gap where it is anchored, e.g. an elastic sheet or one or more elastic strips. The exclusion member could have another conformation, e.g. generally having the form of a triangular or other polygonal prism in which longitudinal faces of the prism or spacers provided on the prism define the frame- and door-contacting surfaces.

The invention claimed is:

1. A safety device for use with a closable member hingedly mounted to a second member, the device comprising an elongate exclusion member and first and second biasing members, the biasing members being adapted such that in use the biasing members urge the exclusion member into a hinge gap defined by the closable member and the second member when the closable member is in an open position, the exclusion member having a conformation such that upon closing of the closable member the exclusion member is ejected from the hinge gap against action of the biasing members, and the device adapted so that, in use, the first biasing member is non-movably fixed to the second member and extends between the exclusion member and the second member and the second biasing member is non-movably fixed to the closable member and extends between the exclusion member and the closable member, and wherein further the first and second biasing members each comprises a resilient member and at least one roll of sheet material which is extendible against action of the resilient member.

2. The device of claim 1, wherein the exclusion member comprises at least one surface having a curved profile which defines a closable member-contacting portion and a second member-contacting portion.

3. The device of claim 2 wherein the curved profile defines an arc.

4. The device of claim 1, wherein each said roll of sheet material extends along substantially the entire length of the exclusion member.

5. The device of claim 1, wherein the exclusion member comprises a closable member-contacting portion and a second member-contacting portion, said portions being configured to facilitate the ejection of the exclusion member from the hinge gap.

6. The device of claim 5 wherein said closable member-contacting portion comprises a plurality of closable member-contacting portions and said second member-contacting portion comprises a plurality of second member-contacting portions, said closable and second member-contacting portions are provided by a plurality of projections provided at intermittent points along a length of the exclusion member.

7. The device of claim 6 wherein the projections are provided adjacent ends of the exclusion member.

8. The device of claim 7 comprising at least one further projection provided at least one point between the ends of the exclusion member along the length of the exclusion member.

9. The device of claim 6, wherein the projections are positioned on the exclusion member so as to facilitate the ejection of the exclusion member from the hinge gap.

10. The device of claim 1 wherein the biasing members are adapted to prevent the exclusion member from being entrapped in the hinge gap.

11. The device of claim 1, wherein the biasing members are adapted to orientate the exclusion member with respect to the closable member and the second member to facilitate the ejection of the exclusion member from the hinge gap.

12. The device of claim 1, wherein each said roll of sheet material comprises a sheet of substantially non-elastic material which is mounted to extend against the action of the resilient member and retract under influence of the resilient member.

13. The device of claim 12, wherein the each said roll of sheet material is adapted to extend by rotation against the action of the resilient member.

14. The device of claim 1, wherein the exclusion member comprises a main body having a substantially constant cross section and a plurality of spacers mounted at positions along a length of the exclusion member which provide projections which define closable member-contacting portions and second member-contacting portions.

15. The device of claim 14, wherein either or both of the closable member-contacting portions and the second member-contacting portions are formed from a material having a low coefficient of friction.

16. The device of claim 1, wherein the second member comprises a frame having a doorstop, and wherein an extension of the first biasing member is stopped once the exclusion member has moved beyond the doorstop.

17. The device of claim 1 wherein the elongate exclusion member comprises an elongate substantially semi-cylindrical member.

18. A closable assembly comprising the safety device according to claim 1.

19. A method of installing the safety device according to claim 1 comprising the steps of: non-movably fixing the second biasing member to the closable member and non-movably fixing the first biasing member to the second member such that the exclusion member in the open position is urged into the hinge gap when the closable member is opened.

* * * * *